US007096788B2

(12) United States Patent
Zeller

(10) Patent No.: US 7,096,788 B2
(45) Date of Patent: Aug. 29, 2006

(54) DEVICE FOR MOUNTING A PRINTING PLATE ON A PLATE CYLINDER FOR A ROTARY PRINTING PRESS

(75) Inventor: Markus Zeller, Lörrach (DE)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/115,334

(22) Filed: Apr. 27, 2005

(65) Prior Publication Data

US 2005/0235850 A1 Oct. 27, 2005

(30) Foreign Application Priority Data

Apr. 27, 2004 (EP) ..... 04405260

(51) Int. Cl.
*B41F 27/12* (2006.01)

(52) U.S. Cl. ..... 101/415.1; 101/378

(58) Field of Classification Search ..... 101/415.1, 101/378, 382.1, 383, 384
See application file for complete search history.

(56) References Cited

U.S. PATENT DOCUMENTS 1,739,585 A * 12/1929 Fleming ..... 101/415.1
2,209,127 A 7/1940 Lowe
2,885,958 A * 5/1959 Johnson et al. ..... 101/415.1
3,058,417 A * 10/1962 Norlin ..... 101/415.1
4,214,530 A 7/1980 Signorelli et al.
4,802,413 A * 2/1989 Schroeder ..... 101/415.1
5,566,615 A 10/1996 Barrois

FOREIGN PATENT DOCUMENTS

DE 34 01 760 A1 * 1/1984
DE 41 38 925 A1 * 6/1993
DE 102 19 073 A1 11/2002
DE 102 20 546 A1 11/2003
GB 526837 A 9/1940

* cited by examiner

*Primary Examiner*—Leslie J. Evanisko
(74) *Attorney, Agent, or Firm*—Venable LLP; Robert Kinberg; Steven J. Schwarz

(57) ABSTRACT

A plate cylinder adapted for a rotary printing press has a cylinder jacket and a recess followed by a clamping channel which extend at least approximately parallel to the rotational axis of the plate cylinder inside the cylinder jacket. The printing plate has a leading end and a trailing end which are both secured inside the recess. A trailing end region of the printing plate includes two parallel bent edges extending transverse to the rotational direction of the plate cylinder. One bent edge is formed by a section of printing plate fitting against the cylinder jacket and another section of the printing plate that projects into the clamping channel which together enclose approximately a right angle. The other bent edge is formed by the section of printing plate projecting into the clamping channel and an end section of the printing plate extending through the clamping channel.

15 Claims, 4 Drawing Sheets

DEVICE FOR MOUNTING A PRINTING PLATE ON A PLATE CYLINDER FOR A ROTARY PRINTING PRESS

CROSS-REFERENCE TO RELATED APPLICATION

This application claims the priority of European Patent Application No. 04405260.3-1251, filed on Apr. 27, 2004, the subject matter of which is incorporated herein by reference. The disclosure of all U.S. and foreign patents and patent applications mentioned below are also incorporated herein by reference.

BACKGROUND OF THE INVENTION

The invention relates to a device for mounting a printing plate on a plate cylinder for a rotary printing press, wherein the leading end and the trailing end of the printing plate are secured inside a recess in the plate cylinder jacket that extends nearly parallel to the rotational axis of the plate cylinder.

It is known to secure a folded edge of a rotating printing plate inside a recess, extending across the width of the plate cylinder and arranged parallel to the rotational axis, and to subsequently wind the printing plate around the cylinder jacket by turning the plate cylinder. The recess, positioned parallel to the rotational axis and also referred to as a plate-mounting channel, ends in an axis-parallel bore with a therein disposed rotating spindle. This spindle functions to grip and clamp-in the printing plate along the back edge, Different devices permitting an automatic securing and ejecting of printing plates are known in the field of sheet printing. The disadvantage of such devices is that they require a large-angle gap in the cylinder jacket.

SUMMARY OF THE INVENTION

It is an object of the present invention to create a device of the aforementioned type which requires only a narrow plate-mounting groove while permitting a reliable mounting and holding of the printing plate on the plate cylinder, as well as a reliable ejection.

The above and other objects are accomplished according to the invention by the provision of an arrangement comprising: a plate cylinder having a rotational axis and adapted for use in a rotary printing press, the plate cylinder having a cylinder jacket and a recess followed by a clamping channel which extend at least approximately parallel to the rotational axis of the plate cylinder inside the cylinder jacket; and a printing plate having a leading end and a trailing end, as seen in the rotational direction of the printing cylinder, which are both secured inside the recess, the printing plate having a trailing end region that includes two parallel bent edges extending transverse to the rotational direction of the plate cylinder, one of the bent edges formed by a section of printing plate which fits against the cylinder jacket of the plate cylinder and another section of the printing plate that projects into the clamping channel and enclosing an approximately right angle, the other of the bent edges being formed by the section of printing plate which projects into the clamping channel and an end section of the printing plate which extends through the clamping channel.

Having a cross-sectional shape of this type for the trailing end region of the printing plate and providing a matching design for the recess in the plate cylinder ensures a reliable mounting on the plate cylinder and favors the option of an automatic mounting of the printing plate. The trailing end region is positioned centered inside the clamping channel, despite an error-tolerant seating. The end regions of the printing plate are pre-formed outside of the printing press.

It is advantageous if the end section has an exposed edge that supports itself against one inside wall of the clamping channel and which provides the trailing end region of the printing plate with stability and rigidity. A frictional connection is thus generated inside the clamping channel between the plate cylinder and the printing plate.

The printing plate section that projects into the clamping channel and the end section of the printing plate advantageously form an acute angle, such that the exposed end of the end section can securely engage in the inside wall of the clamping channel.

It has proven advantageous if the angle between the portion of the trailing end region of the printing plate, which projects into the clamping channel, and the end section is larger prior to the insertion than in the assembled state, so that the tension generated inside the clamping channel favorably effects the securing of the trailing end region in the plate cylinder. The resulting tension generates a clamping force between the exposed end and the inside wall, wherein a sharp edge on the exposed end can favorably enhance this effect. Any attempt from the outside to pull the end region out of the clamping channel would only increase the clamping force.

According to a modified embodiment of the subject matter of this invention, the trailing end of the printing plate can be secured in place and released of a locking element assigned to the clamping channel which clamps in the exposed end of the end portion projecting through the clamping channel. In case the exposed end is unintentionally detached from the inside wall of the clamping channel, the printing plate with its end region is prevented from lifting even slightly off the plate cylinder, thereby preventing any damage to the plate cylinder. The distance between a latching nose on the locking element and the exposed end of the printing plate end portion should therefore be short.

BRIEF DESCRIPTION OF THE DRAWINGS

The invention is explained in the following with the aid of an exemplary embodiment and the drawing to which reference is made for all details not mentioned in the description.

DETAILED DESCRIPTION OF THE INVENTION

Figure 1:
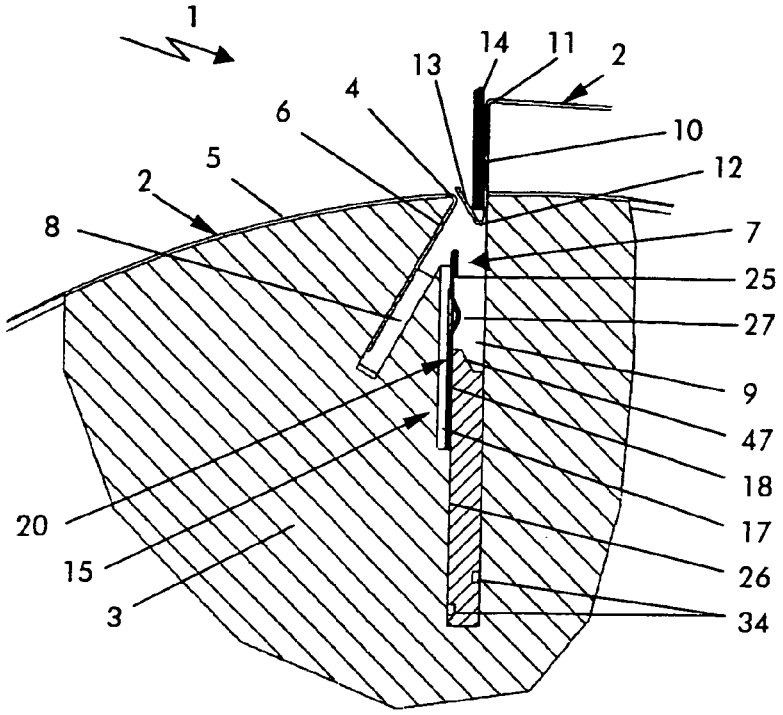
FIG. 1 shows details of a cross section through the plane II—II in FIG. 6, at the instant of inserting the trailing end of the printing plate into a plate cylinder.

FIGS. 1 to 4 are radial cross sections of a printing plate cylinder 3 for a rotary printing press showing the steps for mounting a printing plate on the plate cylinder 3 by an arrangement 1, as well as the removal of the printing plate 2 from the plate cylinder 3.

The printing plate 2 is provided with a bent edge on the front or leading end 4 of the printing plate 2, as seen in a rotational direction F. The bent edge is formed with a section that fits against a jacket 5 of the plate cylinder and a folded end section 6 of the printing plate 2 to form an acute angle in which the leading end 4 of the printing plate 2 engages the plate cylinder 3, such that the printing plate 2 can be subsequently wound onto the plate cylinder 3. The folded section 6 projects into a channel 8 that follows a recess 7 in the plate cylinder 3.

A trailing end 10 of printing plate 2 can be secured inside an approximately radially extending clamping channel 9 which follows the recess 7.

The trailing end 10 of printing plate 2 is provided with two parallel bent edges 11, 12, which extend transverse to the rotational direction F, wherein the outer bent edge 11 is formed by a section that fits against the cylinder jacket 5 and by a section of the printing plate 2 that adjoins the recess 7 in an approximately radial direction to the rotational axis of plate cylinder 3 and extends into the clamping channel 9, thus forming an approximately right angle.

The inner bent edge 12 is formed by a folded-back rear end section 13 of the printing plate 2, which extends at an acute angle to the orientation of clamping channel 9. FIG. 1 furthermore shows the mounting of the printing plate 2, at the point where the trailing end 10 of the printing plate 2 is inserted by means of a sword-type tool 14 which dips into a fold formed by the inner bent edge 12, thus pressing the trailing end 10 of the printing plate 2 into the clamping channel 9.

The acute angle formed by the end section 13 is larger before inserting the trailing end section of the printing plate 2 into the clamping channel 9, than after it is fully inserted, thereby generating an autonomous holding force on the inside wall of clamping channel 9.

Figure 2:
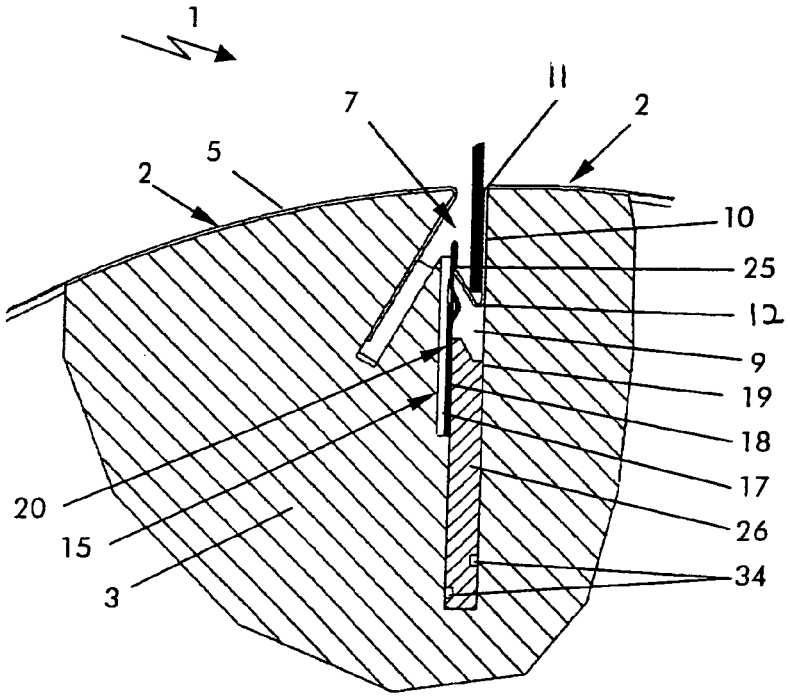
FIG. 2 shows details of a cross section through the plane II—II in FIG. 6 with the printing plate inserted.

FIG. 2 shows the printing plate 2 secured in the clamping channel 9. The clamping channel 9 is provided with a safety device 15. Device 15 consists of a securing element 18 inserted into a pocket 17. The pocket 17, which serves to hold and release the securing element 18, is designed in the manner of a planar depression in the clamping channel 9 and is positioned opposite a guide surface 19 of the clamping channel 9 against which the trailing end 10 of the printing plate 2 comes to rest.

Figure 7:
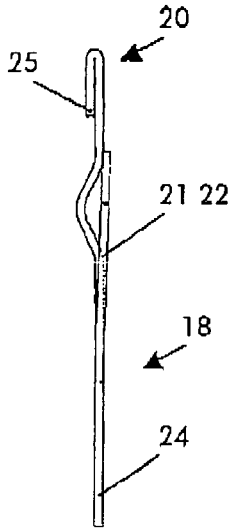
FIG. 7 shows a view of a locking element.
Figure 8:
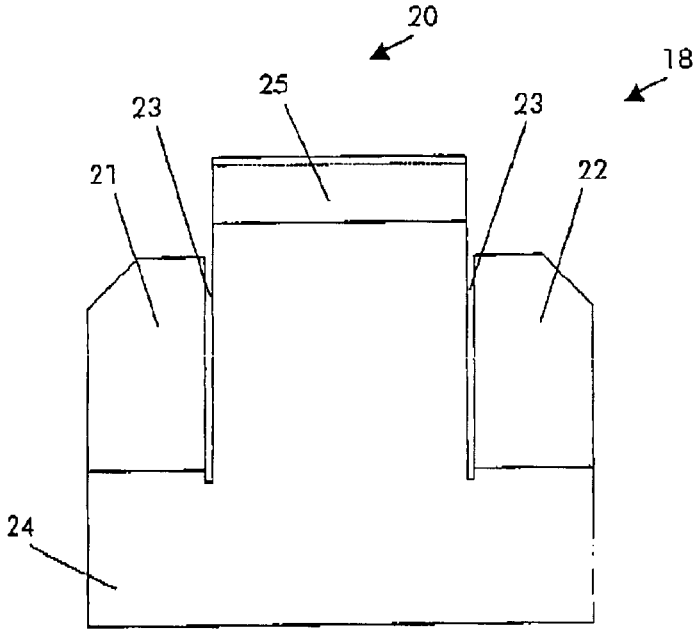
FIG. 8 shows a view from the side of the locking element shown in FIG. 7.

The securing element 18 is illustrated in FIGS. 7 and 8 while its operation is described in connection with FIGS. 1 to 4. Securing element 18 consists of a locking member 20 which can be moved and is arranged such that it can pivot transverse to the extension of clamping channel 9 between two side-mounted holding plates 21, 22 and is separated from these by respective gaps 23. The locking member 20 as well as the holding plates 21, 22 are rigidly connected to a base element 24. The pocket 17 is provided with three indentations in depth which are assigned to the holding plates 21, 22 and the locking member 20. The indentations in the pocket 17 for inserting the holding plates 21, 22 are smaller than the indentation, positioned in-between, for the locking member 20. The latter indentation is deeper to accommodate the movement necessary to secure and release the trailing end of the printing plate 2.

Figure 3:
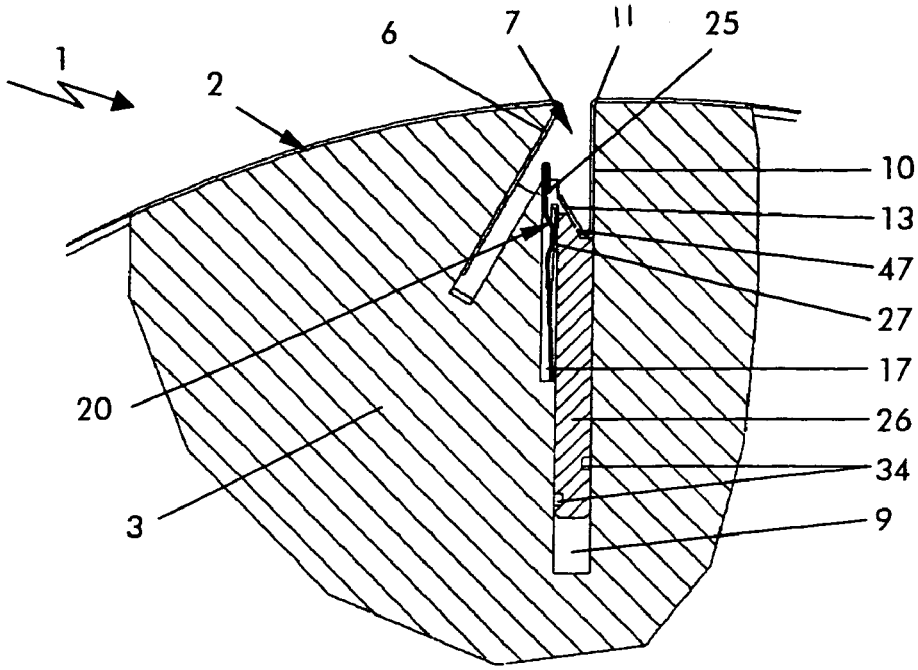
FIG. 3 shows details of a cross section through the plane II—II in FIG. 6 at the instant of ejecting the trailing end of the printing plate from the plate cylinder.
Figure 4:
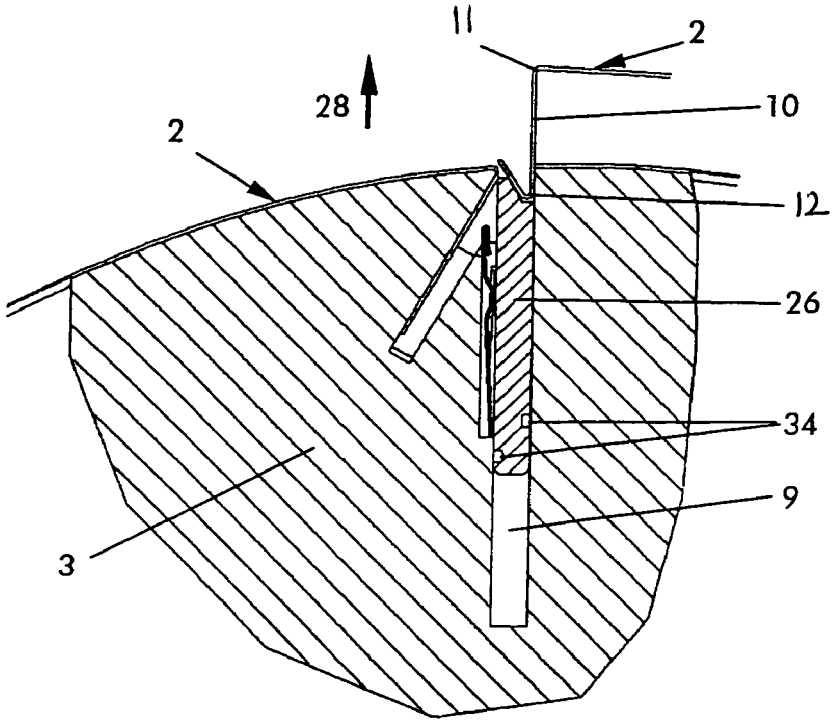
FIG. 4 shows details of a cross section through the plane II II in FIG. 6.

A fold on the upper end of the locking member 20 forms a latching nose 25, against which the rear end section 13 of the trailing end 10 of printing plate 2 comes to rest and/or in which it engages if the exposed end of the end section 13 should disengage from the inside wall of the clamping channel 9 (see FIG. 2). To release the securing and/or anchoring of the trailing end 10 of the printing plate 2, the locking member 20 is provided with a yoke-shaped raised area 27 between the latching nose 25 and an ejection element 26, located in the lower region of clamping channel 9 when in the starting position. When lifting up the ejection element 26, the locking member 20 is pushed toward the side and into the pocket 17 while the latching nose 25 of the locking member 20 is simultaneously released from the locked position. This operation is illustrated in FIG. 3. When releasing the locking member 20 from the secured and/or locked position, the trailing end 10 of the printing plate 2 jumps at least partially out of the recess (see FIG. 4), aided by the raised ejection element 26. Following this, the ejection element 26 which should advantageously extend over most of the width of the plate cylinder 3 is again lowered to assume the rest position in the clamping channel 9, as shown in FIG. 1.

It is important that the end of the ejection element 26 which faces the back end section 13 is designed so as to exclusively grip the end section 13 during the ejection of the trailing end region of printing plate 2 to prevent it from being wedged into the clamping channel 9. It is helpful, for example, if the herein shown slanted flank 47 has a smaller acute angle than the angle formed with the rear end section 13 and the section that approximately fits against the trailing inside wall of channel 9.

The flank 47 which forms a shoulder could also be positioned parallel the extension of clamping channel 9, thereby releasing the clamping force generated by the clamped-in end section 13 during the ejection operation.

The ejection element 26 can be raised and/or lifted up pneumatically, but is restored mechanically. However, the ejection element could also be operated only mechanically.

Figure 5:
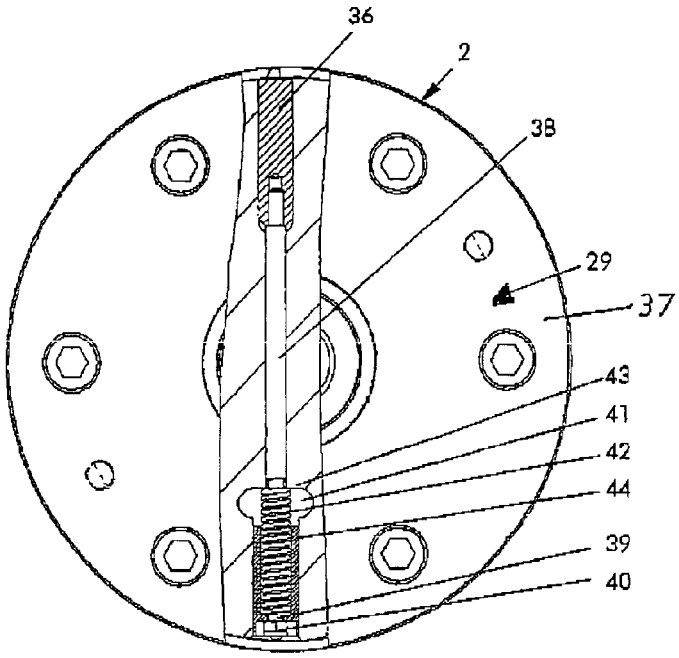
FIG. 5 shows details of a cross section through the plate cylinder and through plane V—V in FIG. 6.
Figure 6:
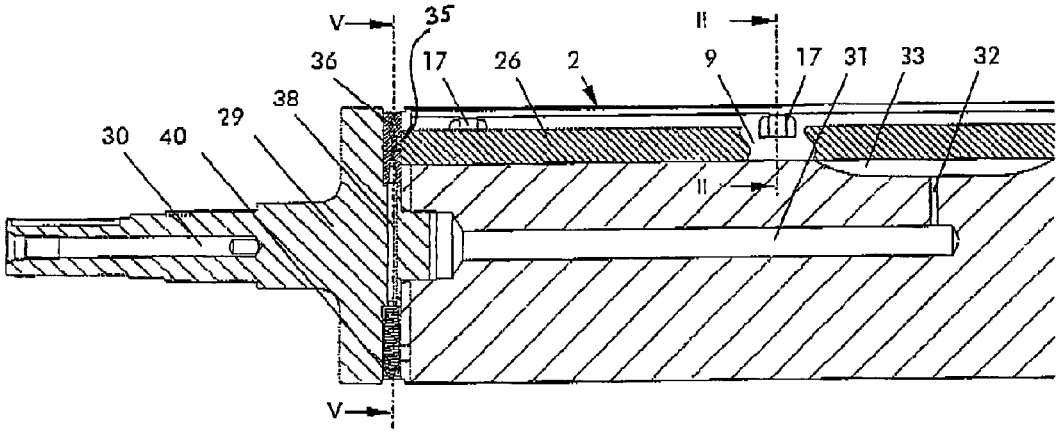
FIG. 6 shows details of a longitudinal section through a plate cylinder and a shaft end.

FIGS. 5 and 6 illustrate the ejection element 26, which forms a part of an ejection device 28, as well as its activation mechanism. Shaft ends 29 are screwed to the end faces (only one of which is shown) of the plate cylinder 3 and function to position the plate cylinder 3 in the machine frame, not shown herein, of a printing press. An air channel 30 extends through the shaft ends 29 and empties into an air channel 31 in the plate cylinder 3. The end of the air channel 31 in the plate cylinder 3 is connected via a connecting line 32 that extends transverse to the plate cylinder axis to an air chamber 33 which follows the clamping channel 9. A pressure is generated by the air channels 30, 31 and the air chamber 33 underneath the ejection element 26 in the clamping channel 9, which functions to lift up the ejection element 26 and/or remove it from the idle position. To prevent compressed air from escaping the clamping channel 9, the ejection element 26 is provided with grooves 34 for inserting seals.

The end portions of the ejection element 26 are designed to function as part of a coupling 35 in which a sliding block 36 is guided inside the shaft end 29 and engages shaft 29 in a form-locking manner. A flange 37 of shaft end 29 is provided, which is screwed to the plate cylinder 3 and accommodates the sliding block 36, which is arranged so as to be displaceable approximately in a radial direction.

The sliding block 36 is connected to a rod 38 which extends through the flange 37 of shaft end 29, approximately perpendicular to the longitudinal extension of plate cylinder 3.

The rod 38 is connected on one end to the sliding block 36 and is provided with a thread 39 with nut 40 on the other end. A compression spring 42 is installed with tension between the nut and a cavity 41 in the flange 37. The compression spring 42 that rests against a shoulder 43 on the inside end of cavity 41 moves the ejection element 26 back to the starting position (as shown in FIGS. 5 and 6). To encourage the lifting movement of rod 38, the compression spring 42 is surrounded by a guide bush 44 that is arranged inside the cavity 41.

Figure 9:
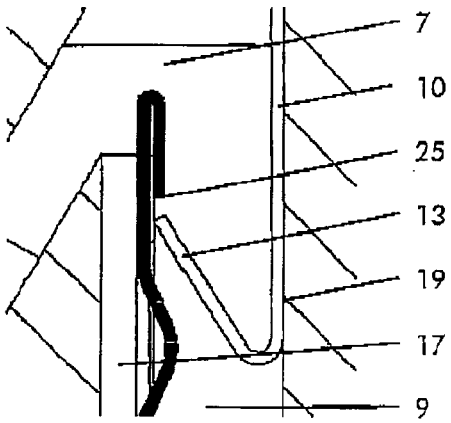
FIG. 9 is a detail from FIG. 2, showing the mounted printing plate.
Figure 10:
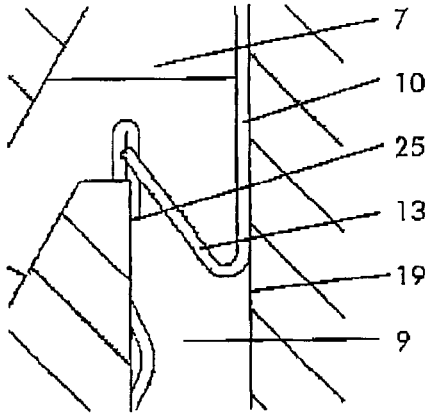
FIG. 10 is a detail from FIG. 3 with detached printing plate.

FIGS. 9 and 10 illustrate enlarged details of the layout as shown in FIGS. 2 and 3.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An arrangement comprising:

a plate cylinder having a rotational axis and adapted for use in a rotary printing press, the plate cylinder having a cylinder jacket and a recess followed by a clamping channel which extend at least approximately parallel to the rotational axis of the plate cylinder inside the cylinder jacket;

a printing plate having a leading end and a trailing end, as seen in the rotational direction of the printing cylinder, which are both secured inside the recess, the printing plate having a trailing end region that includes two parallel bent edges extending transverse to the rotational direction of the plate cylinder, one of the bent edges formed by a section of printing plate which fits against the cylinder jacket of the plate cylinder and another section of the printing plate that projects into the clamping channel and enclosing an approximately right angle, the other of the bent edges being formed by the section of printing plate which projects into the clamping channel and an end section of the printing plate which extends through the clamping channel; and an ejection element arranged inside the clamping channel which is operative to eject the trailing end region of the printing plate from the clamping channel.

2. The arrangement according to claim 1, wherein the end section of the printing plate has an exposed end that is supported on an inside wall of the clamping channel.

3. The arrangement according to claim 2, wherein the section of printing plate which projects into the clamping channel and the end section of the printing plate form an acute angle.

4. The arrangement according to claim 2, wherein the exposed end of the end section is pressed with a tensioning force against the inside wall of clamping channel.

5. The arrangement according to claim 2, and further comprising a securing device in the clamping channel, and wherein the trailing end of the printing plate is secured on and released from the securing device by the exposed end of the end section which extends through the clamping channel.

6. The arrangement according to claim 5, wherein the clamping channel has two parallel side walls, one of which has an indentation for accommodating the securing device.

7. The arrangement according to claim 6, wherein the securing device includes a locking member which is operative to secure the trailing end of the printing plate.

8. The arrangement according to claim 7, wherein the exposed end of the end section that extends through the clamping channel is secured in place automatically by the locking member.

9. The arrangement according to claim 7, wherein the locking member includes a raised area that projects into the clamping channel, between a back side of the end section of the printing plate and the ejection element.

10. The arrangement according to claim 9, wherein a front end of the ejection element is designed to act upon the back side of the end section of the printing plate.

11. The arrangement according to claim 1, wherein the ejection element has a back end as seen in an ejection direction which is disposed for being supplied with compressed air.

12. The arrangement according to claim 11, wherein the clamping channel has a closed end, and the arrangement further includes another channel to couple the closed end of the clamping channel with a source of compressed air.

13. The arrangement according to claim 1, further including a guiding device installed on a side of the plate cylinder, wherein the ejection element is respectively guided inside the guiding device.

14. The arrangement according to claim 13, further including a shaft connected to the plate cylinder, wherein the guiding device is disposed inside an end of the shaft.

15. The arrangement according to claim 13, wherein the guiding device comprises a spring and a rod connected to the ejection device and resting against the spring, the rod being operative to reverse an ejection movement of the ejection element.

* * * * *